United States Patent [19]

Hetzel et al.

[11] 4,275,999

[45] Jun. 30, 1981

[54] AIR COMPRESSOR WITH RAMPED INTAKE VALVE

[75] Inventors: Thomas R. Hetzel; Charles LaBelle, both of Sheboygan, Wis.

[73] Assignee: Thomas Industries, Inc., Sheboygan, Wis.

[21] Appl. No.: 70,013

[22] Filed: Aug. 27, 1979

[51] Int. Cl.[3] ..... F04B 49/00

[52] U.S. Cl. ..... 417/299; 417/550

[58] Field of Search ..... 417/559, 551, 299

[56] References Cited

U.S. PATENT DOCUMENTS

| | | | |
|---|---|---|---|
| 1,470,548 | 10/1923 | Spohrer | 417/550 |
| 2,084,665 | 6/1937 | Aikman | 417/299 |
| 2,792,790 | 5/1957 | Capps | 417/550 |
| 3,606,588 | 9/1971 | Romerhaus | 417/299 |
| 3,961,868 | 6/1976 | Droege et al. | 417/550 |
| 4,028,015 | 6/1977 | Hetzel | 417/555 R |

*Primary Examiner*—Billy J. Wilhite

*Attorney, Agent, or Firm*—George F. Lee

[57] ABSTRACT

An air compressor has a low torque motor driven piston of the rocking rod type which operates in a cylinder with a closed head containing a discharge check valved port to a compressed air receiving chamber. The piston contains an intake port provided with a thin flexible metal spring closure strip which is inclined at a small angle to the valve seat about said intake port to open on the downstroke of the piston, close on the upstroke thereof and remain open when at rest to facilitate start and restart of the air compressor.

8 Claims, 8 Drawing Figures

AIR COMPRESSOR WITH RAMPED INTAKE VALVE

This invention relates to air compressors and particularly to those of the rocking piston rod type.

The object of the invention is to provide means which vent the compression chamber of the compressor in its halted condition so as to facilitate its start and restart against back pressure.

In U.S. Pat. No. 3,961,868 there is disclosed a low cost compressor of general utility having a high efficiency of output, a long life expectancy and requires a minimum of service. Said compressor employs a wobbling piston having a unitary flanged Teflon disc or cup which serves first as a guide for the piston in the compression cylinder and secondly as a pneumatic seal of the piston to the wall of the cylinder in which it moves. The piston contains a flexible intake valve through which the compression cylinder is loaded on the piston downstroke with a charge of air which is then trapped by the intake check valve on the upstroke of the piston. The compressor also includes a discharge check valve in its cylinder head which opens on the upstroke of the piston to receive the compressor delivery and closes on the piston downstroke to prevent backward flow from the discharge chamber into the cylinder. However, the torque requirements of the compressor motor are high. In practice it has been found that such air compressors can experience difficulty in starting and restarting. For example, should the piston stop near dead center, a high vacuum may result when the unit is started causing its motor to stall. This can be overcome by utilizing a larger motor but this adds to the cost.

In U.S. Pat. No. 4,028,015, there is disclosed a similar compressor in which the intake valve through the piston head has been replaced by an intake port located in the cylinder near the bottom of the piston stroke, and the cylinder is provided with a smaller-diameter bleed hole higher up in the cylinder wall at a location where it will be open for the least amount of time to minimize output loss. This hole allows air to bleed into the cylinder to "break the vacuum" and so allows the compressor to start easily when equipped with a motor of low torque.

The prior art also has proposed to employ a solenoid-operated valve or pressure switch which "dump" the cylinder to reduce the torque requirement on start up. However, such structure comprises many parts, is complex and costly to build.

In accordance with this invention, the intake check valved port through the piston has been retained but modified to comprise a flexible thin spring metal planar closure strip which is stationarily fixed at one end but inclined at a small angle to the planar seat provided about the piston intake port. Such a valve closure strip is capable of functioning in a manner similar to that as described for the intake check valve of U.S. Pat. No. 3,961,868. It is capable of flexing outwardly on the downstroke of the piston to admit a charge of air into its compression chamber and it snugly engages the valve seat on the compression stroke so that a maximum quantity of the captured charge of air is delivered into the receiving chamber thereof.

A feature, however, is that each time that the compressor is halted, the valve closure strip comes to rest at a position spaced off the surrounding valve seat. The uncovered intake port vents the compression chamber so that on startup there is an equalization of pressure inside and outside the cylinder. The result is that the torque requirement of the piston drive motor is small and the compressor can be easily started and restarted.

The required inclination of the valve closure strip to the valve seat need be only a few degrees and is easily accomplished. For example, the valve seat about the intake port in the piston head plate may be machined at a small angle and the blade spring comprising the valve closure fixed at one end to the flat top of its mounting pad so that it comes to rest in a horizontal position over the inclined valve seat. Alternatively, the valve seat may be ground horizontal or flat and a recessed area machined in the piston head having an inclined planar base area to which the valve closure strip is fastened. In both arrangements, the valve closure strip is adapted to respond to piston movement driving operation of the compressor and to vent the cylinder chamber on shutdown for ease of start up.

Alternatively, the piston may be provided with a second or auxiliary relief valve which supplements the intake check valve. Such a relief valve would be similarly structured as described above so that it opens each time the air compressor is halted to permit equalization of pressure in the cylinder to the surrounding atmosphere. In operation of the compressor, it works in conjunction with the intake valve closure to load compressed air through the discharge valve port.

A feature of the invention is that the components making up the intake check valve port in the piston are simple and uncomplicated. In fact they may be substantially unchanged from that shown in U.S. Pat. No. 3,961,868 in which event only the inclination of the mount for the valve closure strip and disposition of the valve seat are changed. As indicated, this is readily accomplished either in the casting of the piston head plate or by appropriately machining selected areas thereof. Of consequence, the invention adds only minimally to the overall costs of the compressor and the valve closure continues to operate as before. However, the invention permits use of a smaller and therefor less costly motor of low torque to operate the compressor and the output of the compressor is not substantially decreased. Any loss in output is more than balanced by the assurance that the motor will restart each time it is halted so that there is no interruption of service. At the same time all of the features and advantages of such a compressor are retained.

It will be appreciated that the inclination of either the ramped valve closure mount or the ramped valve seat will determine the compressor's starting pressure and therefor torque requirements of the motor.

Other objects, advantages and features of the invention will be apparent or will become so upon consideration of the presently preferred embodiments of the invention which now will be described in connection with the accompanying drawing.

Figure 1:
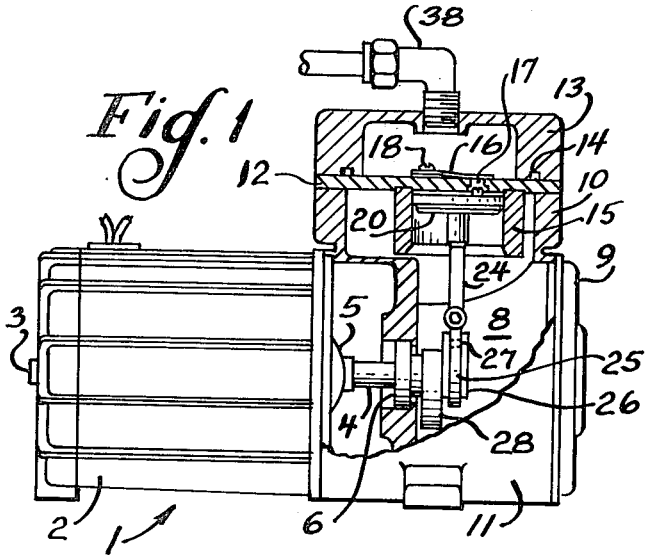
FIG. 1 is a side elevation of a motor compressor unit embodying the present invention, portions thereof being broken away to reveal other working parts of the compressor.
Figure 2:
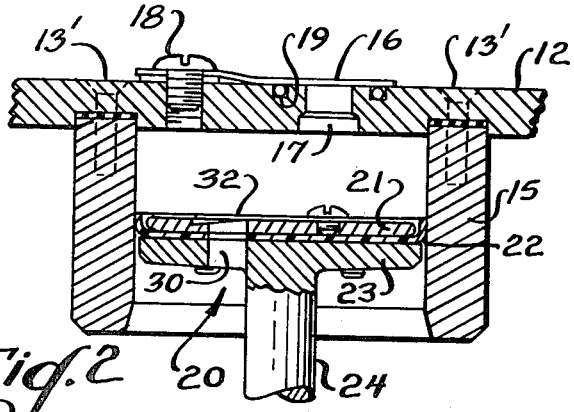
FIG. 2 is a view which illustrates on a larger scale details in the construction of the compression chamber and the piston which operates in said cylinder.

Referring now more specifically to the several views which comprise the drawing, and wherein like parts are identified by like reference numerals, the compressor unit of FIG. 1 comprises a frame 1 embodying a barrel portion 2 which enclose a motor 5. At 3 a shaft bearing provides support for one end of the armature shaft 4 which extends from the armature of the motor 5 through the ball bearing 6 which is mounted in the near end wall of the crank case 8. A disk-like closure 9 concentric with shaft 4 contains a central air admission screen (not shown) closing the right hand end of the crank case 8 in FIG. 1. Crank case 8 has a hollow vertical neck 10 which opens at its lower end into the crank case 8. An annular horizontally cylindrical flange 11 is formed as a lateral extension of the generally cylindrical crank case 8 and joins with the cylindrical motor shell 2. Said shell 2, neck 10 and flange 11 together comprise the compressor frame identified above generally as 1. A cylindrical supporting plate 12 is fixed in horizontal position on the neck 10 of said frame 1 and an inverted cup-like shaped discharge chamber 13 for receiving the compressed air is clamped thereto by bolts not shown which hold the rim of the cup-shaped chamber 13 against the top of the cylinder supporting plate 12. An O-ring seal 14 is disposed between the discharge chamber 13 and the cylinder supporting plate 12. At 15 is an aluminum cylinder having a hard-coated inner surface which is set into and sealed to the lower side of the cylinder supporting plate 12 as by vertically disposed clamping screws 13 (FIG. 2). As afterwards sometimes identified, said plate 12 comprises the head of cylinder 15 in which is contained a discharge port 17 establishing communication between the compression cylinder 15 and the compressed air receiving chamber 13. Flow through said discharge port 17 is govered by a spring strip check valve 16 fastened by a screw 18 to the upper side of the cylinder supporting plate or head 12. At 19 is an O-ring seal in a circular groove of square cross section in the cylinder head plate 12 which cooperates with the spring strip discharge valve closure 16.

At 20 is a wobble piston which comprises a circular metal disk or piston head plate 21 and a base plate 23 between which is mounted a cup-shaped packing member 22 having a free flange which constantly engages the inner walls of the cylinder 15. Disk 22 may be made of Teflon and cooperates with the inside cylindrical surface of the cylinder 15 to effect a continuous seal about the piston with the inside cylinder surface in operation of the compressor. Cylinder 15 is preferably of aluminum and its inner surace hardened and burnished by known treatment to provide a thin but very hard wear-resistant surface which cooperates with the cup-shaped packing member 22 of the wobble piston 20. Piston head plate 21, Teflon cup-shaped packing 22 and the piston plate 23 are hereinafter collectively referred to as the piston head which is shown in FIGS. 1 and 2 rigidly mounted on the end of piston rod 24. The margins of the thin cup-shaped packing 22 tend to spring out radially and so maintain contact with the inner walls of the cylinder throughout its various positions. Piston rod 24 at its lower end has a split clamp 25 which embraces the outer ring of the ball bearing 26 which is carried on the crank 27 and which in turn is concentrically mounted on the motor shaft 4. A counter-balance 28 substantially counter balances the eccentric weight of the piston 20 and its rod, the crank pin 27 and the ball bearing 6.

The intake from atmosphere inside the crank case 8 to the interior chamber of the compressor cylinder 15 extends through a passageway 30 formed through the piston 20 including its piston plate 23, the intermediate cup-shaped packing member 22 and the piston head plate 21. These parts are clamped together by screws 31 the heads of which are visible in FIG. 3, for example. At 32 is a flexible intake check valve closure strip which governs opening and closing of the intake port or passageway 30 through the piston. One end 34 of said valve closure strip 32 is stationarily fastened to the flat top surface of the provided mounting pad 35 on piston head plate 21 as by screw 36 which threadedly connects to said plate 21.

In operation of the compressor, on the downstroke of the piston valve closure, the outer free end 33 of the valve closure strip 32 is flexed upwardly against the resistance of its end 34 and away from the intake port 30 so that the cylinder chamber charges with air.

On the upstroke of the piston, the outward end 33 of the intake closure 32 is loaded by the compressed charge of air collected within the cylinder between the piston and the underside of the cylinder head 12 so that it firmly engages valve seat 41 which surrounds the intake port 30. As the pressure of the compressed air collected in the cylinder 15 increases with the rise of the piston 20 within cylinder 15, the discharge check valve closure strip 16 is flexed away from the discharge port 17, allowing the compressed air to be forced therethrough into the receiving chamber 15 for delivery through outlet pipe 38.

Figure 3:
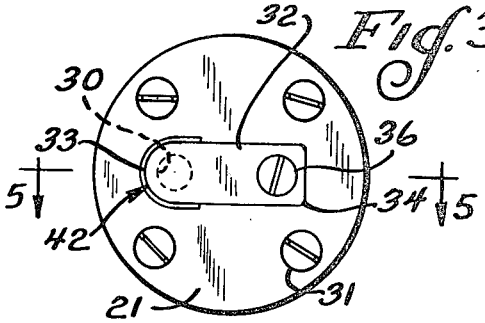
FIG. 3 is a top plan view of the piston head plate shown in FIG. 2.
Figure 5:
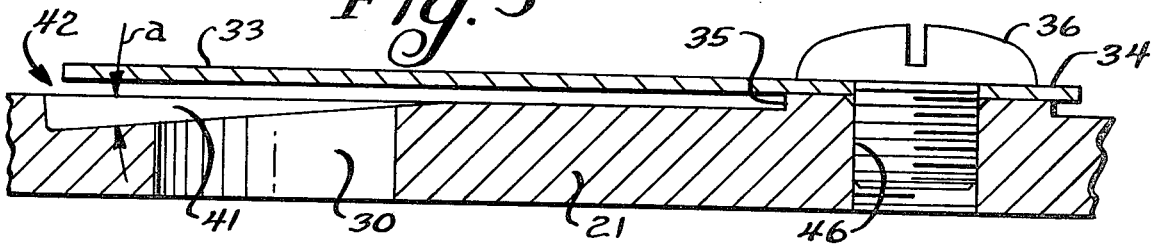
FIG. 5 is a fragmented sectional view through the cylinder taken along lines 5—5 of FIG. 3.

In accordance with this invention, the intake valve closure strip 32 comprises a thin flexible spring metal strip tensioned to retain its illustrated planar disposition (FIG. 5) although yieldable in response to developing pressure exerted thereto in operation of the compressor. FIGS. 3 and 5 illustrate one form thereof wherein its attached end 34 is shown stationarily fixed to the horizontally disposed flat or planar top surface of mounting pad 35 as by screw 36 so that in the halted state of the compressor, it extends generally horizontal and/or normal to the axis of the cylinder 15 and its intake port 30. In this embodiment of the invention, intake port 30 is surrounded by a planar valve seat 41 which is recessed below the top surface of the piston head plate 21 and is inclined at a small angle a, for example 5 to 7 degrees to horizontal. In its "at rest" position as illustrated in FIG. 5, the intake valve closure strip 32 is disposed generally horizontal and its outer end 33 is spaced above the inclined or ramped valve seat 41 so that the cylinder communicates at 42 about the free end portion 33 of the closure strip to the interior of the compressor 1. Thus each time the compressor motor is halted and the compressor piston comes to rest, the compressor is readied for start up by return of the intake valve closure strip 32 to its "at rest" position. As illustrated in FIG. 5, the intake valve closure strip 32 is disposed generally horizontal and its outer end 33 is spaced above the inclined or ramped valve seat 41 so that the cylinder communicates at 42 about the free end portion 33 of the closure strip to the interior of the compressor 1. Thus each time the compressor motor is halted and the compressor piston comes to rest, the compressor is readied for start up by return of the intake valve closure strip 32 to its "at rest" position (FIG. 5) in which position the compression cylinder 15 is vented to atmosphere through space 42 about the free end 30 of said intake valve closure strip 32. Thus, on start up of the compressor, the torque requirements of the motor are minimal because of the equalization of the presssure within the cylinder 15 with the outside atmosphere through which the piston moves in response to energizing of its drive motor.

Figure 4:
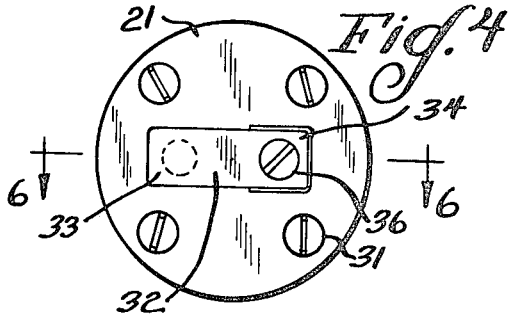
FIG. 4 is a view similar to FIG. 3 and illustrates a second embodiment of the invention.
Figure 6:
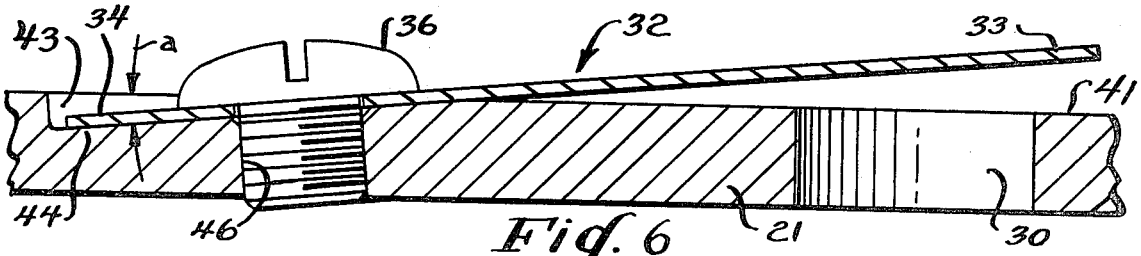
FIG. 6 is a view similar to FIG. 5 and details the embodiment illustrated by FIG. 4, the view being taken along lines 6—6 of said FIG. 4.

Now referring to FIGS. 4 and 6, in a second embodiment of the invention it will be seen that the mounting pad 35 of the first described embodiment on which the valve closure strip 32 is fixed has been replaced by a recessed area 43 having a base surface 44 which is both planar and inclined at a samll angle a of 5 to 7 degrees to which the fixed end 34 of the closure member 32 is fixed as by screw 36 which threadedly connects into the threaded opening 46. Thus the valve closure strip 32 in this second embodiment is also spaced over the intake port 30. The operation of the valve closure plate 32 is exactly the same as in the first described embodiment of FIG. 3 and 5. On the downstroke of the piston the free end 33 of the intake valve closure plate 32 is flexed upwardly and away from the piston head plate 21 so as to open wide the intake port 30 so that the piston cylinder 15 charges with air. On the reverse upstroke of the piston, the free end 33 of the intake valve closure plate 32 is closed against the planar valve seat 41 by the increasing pressure developed in the piston cylinder so that only miminal amount of air is lost; and as the piston closes against the cylinder head plate 12, the developing pressure within the cylinder increases to a level which forces open the discharge valve closure 16 and the developed compressed air exits through the discharge port 17 into the compressed air receiving chamber 15.

As the developed pressure in the area to which the supply pipe 38 leads is raised to a predetermined level, the drive motor cuts off and movement of the piston within its cylinder 15 is temporarily halted. As the pressure therein starts to recede, the valve closure 32 will seek its rest position. In doing so, it will incompletely close the intake port and the piston cylinder chamber is vented to the surrounding atmosphere, thus readying the compressor for start up.

Figure 7:
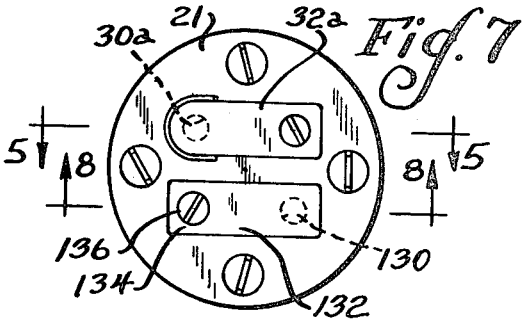
FIGS. 7 and 8 illustrate a modification of the invention.
Figure 8:
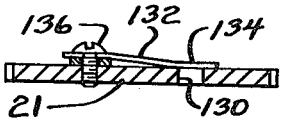

Referring now to FIGS. 7 and 8, in a modification of the invention the piston head plate 21 is provided with a pair of intake check valve ports. One of these, is illustrated in FIG. 8, as comprising an intake port 130 through the piston head which is closed by a spring metal strip closure plate 132 having one end stationarily fixed to the top side of the piston head plate 21 as by screw 136 and its opposed end 134 tensioned so that it is normally sealed against the surrounding valve seat of port 130 to minimize output loss at the start of the upstroke of the piston. The second intake port **30*a* and its closure 32*a*, however, will be constructed in accordance with the embodiments of either FIGS. 3 and 5 or FIGS. 4 and 6**.

In this modification of the invention, intake port **30*a* and closure 32*a* comprise an auxiliary intake valve which supplements the function of the primary intake valve represented at 130 and its closure 132. Thus the closure 32*a* of said auxiliary intake valve is operated in conjunction with the primary intake valve closure and opens on the downstroke of the piston to permit cylinder 15 to be charged with air from the surrounding environs and then closes on the piston upstroke to compress said air charge and deliver it through the discharge port 17. However, its primary function is to vent the cylinder chamber 15 to atmosphere each time the air compressor is stopped and so to ease start up; and wherefor a drive motor of low torque will suffice to operate the compressor. Because of its auxiliary or supplemental role intake port 30*a* can be smaller than the primary intake port 130**.

Thus having described the invention what is claimed is:

1. In an air compressor having a frame, a motor-driven crankshaft journalled in said frame, a cylinder supported in said frame having an open end toward the crankshaft and a closed cylinder head away from the crankshaft, a piston in the cylinder operatively connected to the crankshaft such that rotation of the crankshaft drives said piston to and fro in said cylinder, the head of said piston containing a through port and an air intake check valve which opens on the downstroke of the piston for admitting a charge of air into the cylinder through said port and closes on the upstroke of the piston to compress said charge against the cylinder head, and said cylinder head containing a through port and a discharge check valve which opens to receive said compressed charge of air on the upstroke of the piston, the improvement wherein the intake check valve includes:

a thin, flexible spring metal closure strip stationarily fastened to the piston head and having a planar portion overlying the intake port, and the intake port having a planar valve seat thereabout against which the planar portion of the intake check valve closes on the upstroke of the piston, said planar portion of the closure strip being inclined to the valve seat in its "at rest" position so that the cylinder vents through the piston to atmosphere when the compressor is halted.

2. The improvement according to claim 1 wherein the intake valve closure strip is planar along its length and has one end stationarily fastened to a planar mounting pad on the top side of the piston head, one of said planar mounting pad and planar valve seat being generally horizontal and the other inclined at a small angle thereto.

3. The improvement according to claim 1 wherein the valve closure strip is disposed generally horizontal when at rest and the valve seat comprises a recessed area shaped to receive the overlying portion of the valve closure strip on the upstroke of the piston, the base of said recessed area being planar and inclined to the horizontal at a small angle.

4. The improvement according to claim 1 wherein the piston head includes a depressed area having an inclined planar base to which one end of the valve closure strip is fastened, said closure strip being supported thereby at an inclined angle over the valve seat.

5. In an air compressor, the combination of a frame, a motor-driven crankshaft rotatably journalled to said frame, a compression cylinder supported in said frame having an end toward the crankshaft open to atmosphere and a closed cylinder head away from the crankshaft, a rocking rod piston in the cylinder operatively connected to the crankshaft such that rotation of the crankshaft drives said piston within the cylinder toward and away from the cylinder head, and a compressed air receiving chamber on the opposite side of the cylinder head, the piston containing an intake port and closure means which opens to admit a charge of air from atmosphere through the piston head into the compression chamber on the downstroke of the piston and is closed on its upstroke for compression of said charge, the cylinder head containing a normally closed discharge check valve port which opens on the upstroke of the piston for discharge of said compressed air into the receiving chamber, the piston containing a planar valve seat on its cylinder-head-facing side about the intake port, and a closure member therefor comprising a planar strip which flexes into and out of engagement with the ported valve seat in response to piston movement, said closure member disengaging from its ported valve seat in the halted state of the compressor such that the compressor cylinder vents to atmosphere through the piston.

6. The combination of claim 5 wherein, the closure member is a thin flexible spring metal planar strip which is fastened at one end to the piston and is inclined to the planar valve seat about the intake port such that it disengages from the valve seat when the compressor is halted so that the compression chamber is vented through the intake port to the atmosphere on start up of the compressor.

7. The combination of claim 5 wherein the planar seat is recessed below the surface of the cylinder head facing side of the piston and is inclined at a small angle to the planar disposition of the valve closure strip which it assumes when at rest.

8. In a compressor, means defining a compression chamber having an intake port through which fluid is admitted into the chamber and an exhaust port through which the fluid discharges therefrom, a first check valve which closes the intake port and a second check valve which closes the exhaust port, motor-driven means in said chamber which cyclically open the intake port valve to charge the compression chamber with fluid and then to discharge said fluid through the exhaust port, the intake port valve closing as the exhaust port valve opens, the intake port having a surrounding planar valve seat, and its associated check valve embodying a planar closure strip of thin, flexible spring metal having one end stationarily fixed with its free end overlying the planar valve seat about said port, said closure strip in its unflexed stage assuming a planar dispostion with its free end disposed over the planar valve seat and inclined at an angle to the plane thereof, said closure strip being capable of flexing in response to the cyclic movement of the motor-driven means to open and close the port during operation of the compressor, and, in the halted state of the compressor, to assume its planar disposition such that the intake port is open to facilitate start and restart of the compressor.

* * * * *